United States Patent [19]

Champlin

[11] 4,324,328

[45] Apr. 13, 1982

[54] CARRIER FOR A PLURALITY OF ARTICLES

[75] Inventor: Charles L. Champlin, Rittman, Ohio

[73] Assignee: Packaging Corporation of America, Evanston, Ill.

[21] Appl. No.: 149,021

[22] Filed: May 12, 1980

[51] Int. Cl.[3] ..... B65D 75/04

[52] U.S. Cl. ..... 206/194; 229/28 BC; 206/193; 206/162

[58] Field of Search ..... 206/199, 193, 194, 200, 206/147, 175, 176, 162, 181; 229/28 BC

[56] References Cited

U.S. PATENT DOCUMENTS

| | | | |
|---|---|---|---|
| 2,637,480 | 5/1955 | Forrer | 229/28 BC |
| 2,841,279 | 7/1958 | Forrer | 206/162 X |
| 3,356,283 | 12/1967 | Champlin | 206/194 X |
| 3,747,801 | 7/1973 | Graser | 206/193 |
| 4,049,116 | 9/1977 | Cope | 206/194 X |
| 4,234,081 | 11/1980 | Champlin | 229/28 BC X |

*Primary Examiner*—Steven M. Pollard

*Attorney, Agent, or Firm*—Neuman, Williams, Anderson & Olson

[57] ABSTRACT

A carrier is provided for use in manually carrying a plurality of articles arranged in a pair of substantially parallel rows. The carrier includes a base panel for subtending and supporting the rows of articles. End panels are foldably connected to and extend upwardly from first opposed peripheral segments of the base panel. Side panels are foldably connected to and extend upwardly from second opposed peripheral segments of the base panel. Interconnecting and spanning the distance between the upper portions of the end panels is an elongated hand-gripping unit. The unit defines a substantially vertical plane extending between the rows of articles. Foldably connected to and extending outwardly in opposite directions from the lower portion of the unit are article-retaining flaps. Each flap is provided with means for supportingly accommodating the necked portions of the articles of a row. When the flap is in an outwardly extending article-retaining position, the edge thereof opposite the folding connection is secured to the upper portion of the corresponding side panel.

8 Claims, 13 Drawing Figures

FIG. 1
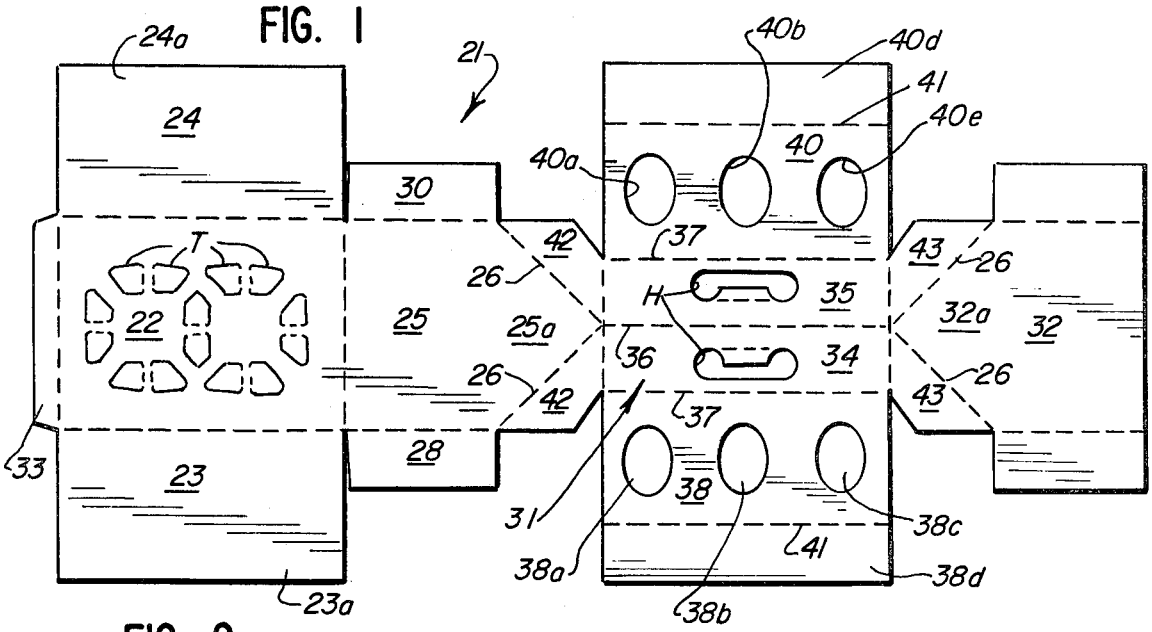
FIG. 2
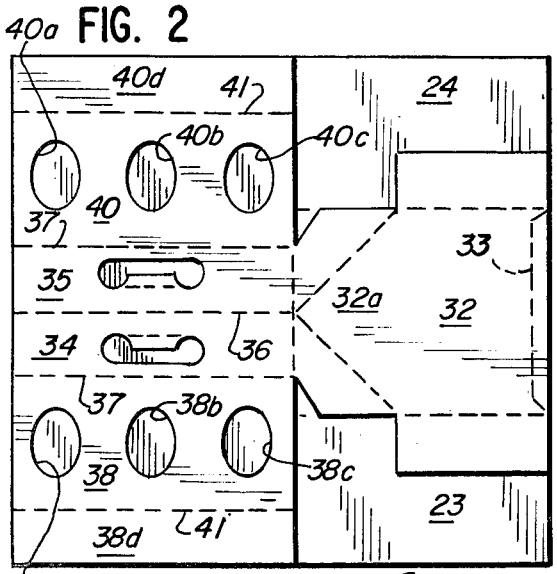
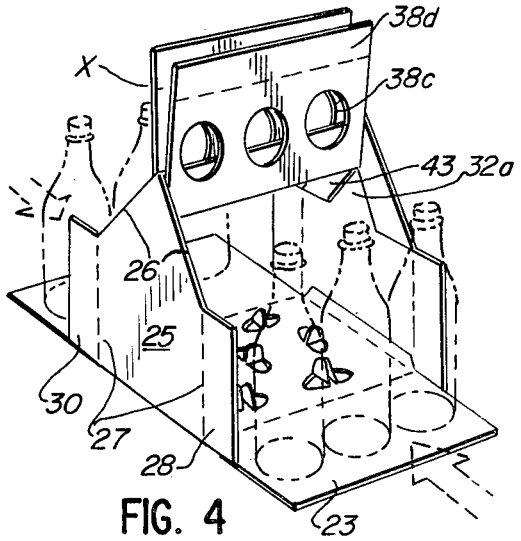
FIG. 4
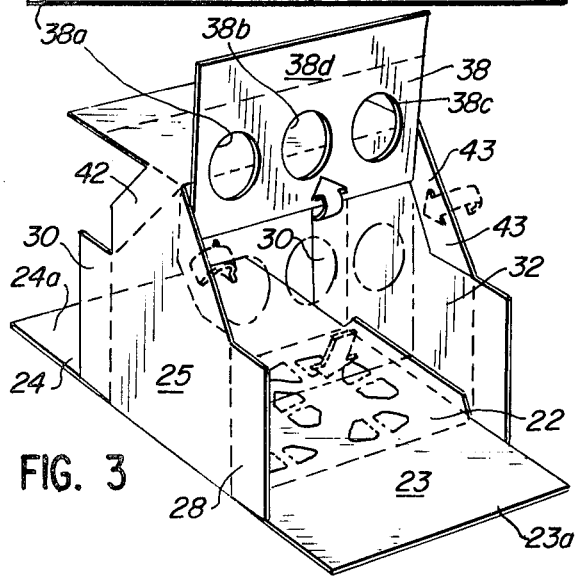
FIG. 3
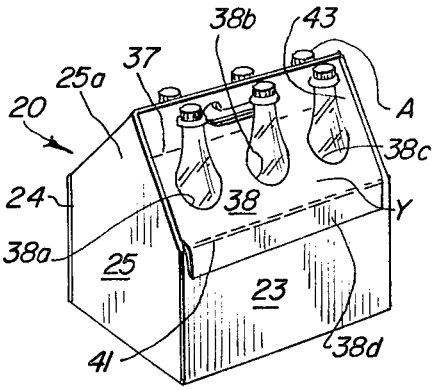
FIG. 5

CARRIER FOR A PLURALITY OF ARTICLES

BACKGROUND OF THE INVENTION

The marketing of bottled beverages in quantities of six or more has become popular with the consuming public. In addition, for reasons of ecology and the conservation of raw material, it has become customary for the seller to require the purchaser of the bottled beverage to pay a bottle-deposit, thereby providing an incentive for the purchaser to return the bottles when empty. Because of these merchandising practices and for the convenience of the customer, it is important that the bottle carriers provide comfort, convenience, and safety for the customer when initially handling same, and that the carriers are capable of being subsequently used by the customer to facilitate return of the empty bottles.

Various carriers have heretofore been provided in an effort to meet these objectives; however, because of certain inherent design characteristics they have been beset with one or more of the following shortcomings: (1) they were of complex and costly construction and difficult to set up; (2) they were difficult not only to set up, but also to load with automatic high-speed equipment; (3) they provided ineffective protection for the accommodated bottles and contents thereof during normal handling of the loaded carrier; (4) the handles of the carriers interfered with proper and stable stacking of loaded carriers during storage and bulk shipping thereof; (5) the carriers were awkward and uncomfortable to manually carry; (6) it was necessary to substantially mutilate or deface the carrier in order to remove an article therefrom, thereby seriously impairing the reusability of the carrier; (7) the carriers were inherently weak and incapable of accommodating a variety of articles; and (8) they were formed from blanks utilizing an inordinate amount of blank material.

SUMMARY OF THE INVENTION

Thus, it is an object of the invention to provide an improved carrier which avoids all of the aforementioned shortcomings.

It is a further object to provide an improved carrier which may be readily stored in a collapsed state.

It is a further object to provide an improved carrier which securely retains the loaded bottles in proper relative spaced positions within the carrier and at the same time provides an effective light shield for the bottle contents.

Further and additional objects will appear from the description, accompanying drawings, and appended claims.

In accordance with one embodiment of the invention, an improved carrier is provided for use in carrying a plurality of necked articles arranged in a pair of substantially parallel rows. The carrier is formed from a single blank of foldable sheet material and includes a base panel which subtends and supports the rows of articles. Foldably connected to opposed first peripheral segments of the base panel is a pair of upright end panels. Connected to opposed second peripheral segments of the base panel is a pair of foldable upright side panels. Means are provided for interconnecting the end and side panels and retaining same in a predetermined upright angular relation. Interconnecting the upper portions of the end panels and spanning the distance therebetween is an elongated hand-gripping unit. The unit is disposed above the base panel and defines a plane which is substantially perpendicular to the base panel and extends between the rows of articles. Foldably connected to the lower portion of the hand-gripping unit are article-retaining flaps. The flaps are movable independently of one another between an upright inoperative article-loading position and an outwardly projecting operative article-retaining position. Each flap is provided with a plurality of relatively spaced openings, which are sized and located so as to supportingly accommodate the necks of the articles forming a row when the flap is disposed in an operative position and effectively restrain lateral shifting of the accommodated articles.

DESCRIPTION

For a more complete understanding of the invention reference should be made to the drawings wherein:

FIG. 1 is a plan view of a blank for one form of the improved carrier.

FIG. 2 is similar to FIG. 1, but showing the blank in a collapsed folded condition suitable for storage or the like.

FIG. 3 is a fragmentary perspective view of the blank of FIG. 1 partially set up and showing the panel sections of the hand-gripping unit being moved relative to one another into face-to-face relation.

FIG. 4 is a perspective view similar to FIG. 3 and showing the blank set up for simultaneously loading articles from opposite sides of the carrier and with the article-retaining flaps disposed in an inoperative position.

FIG. 5 is similar to FIG. 4, but showing the carrier loaded and with the article-retaining flaps thereof in operative positions.

Figure 6:
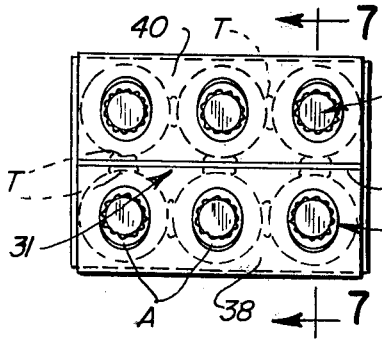
FIG. 6 is a top plan view of the loaded carrier of FIG. 5.
Figure 7:
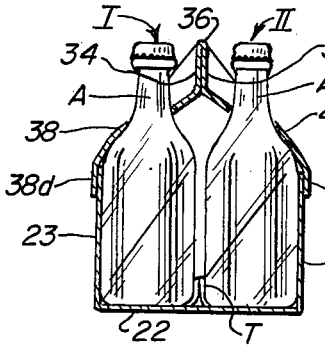
FIG. 7 is a sectional view taken along lines 7—7 of FIG. 6.

Referring now to the drawings, and more particularly to FIGS. 5–7, one form of improved carrier 20 is shown which is adapted to accommodate a plurality of necked articles A arranged in a pair of substantially parallel rows I, II. The articles, as illustrated, are capped bottles commonly utilized in the retailing of beer and other beverages. Each row of articles, in the illustrated embodiment, consists of three articles disposed in upright, side-by-side relation. The number of articles comprising a row may vary, but at present, it has become popular for bottlers and retail merchants to package such articles in quantities of six.

In accordance with various governmental rules and shipping regulations, it is necessary when packaging in carriers articles susceptible to breakage, such as glass bottles, that means be provided to prevent contact between adjacent articles when the carrier is subjected to normal handling. To comply with such rules and regulations it is necessary in most instances that spacers of predetermined thickness be inserted between the adjacent articles. Such spacers are normally of a fiberboard material, strategically located, and of such size and shape as to ensure the necessary and effective separation between adjacent articles. In the past, the spacers were oftentimes separate pieces, or were tabs or flaps integral with the carrier blank. In either instance, difficulty was encountered in integrating the positioning of the separate spacer piece or pieces, or folding and inserting of the tabs or flaps with other manipulations required in setting-up and loading the carrier. Furthermore, when the shape, size, and number of the articles changed, the aforenoted difficulties oftentimes became more acute.

Carrier 20 avoids the aforementioned problems and at the same time fully complies with all of the governing rules and regulations. Carrier 20 is formed from a single blank 21 of foldable sheet material, as seen in FIG. 1, which normally has only one finished surface suitable for printing or the like. Blank 21 includes a bottom, or base, panel 22, normally of rectangular configuration, which subtends and supportingly engages the row of articles I, II. Foldably connected to opposed edges of panel 22 are side panels 23, 24. Foldably connected to an end edge of panel 22 is an end panel 25. As will be noted, the (upper) portion 25*a* of the end panel opposite the base panel 22 has a tapered configuration which is formed by reason of converging foldlines 26. The foldlines 26 extend from corresponding foldlines 27, which extend from the base panel and form the side edges of panel 25. Attached to opposite sides of the end panel 25 are foldable tuck flaps 28, 30. The flaps 28, 30 are adhesively secured to the respective side panels 23, 24 and retain the latter in proper upright positions relative to the base panel 22 when the blank is fully set up.

Extending sidewise from the apex of end panel 25, as seen in FIG. 1, is a hand-gripping unit 31, which will be described more fully hereinafter. Disposed sidewise of unit 31 is a second end panel 32 which is of substantially the same configuration as panel 25. The apex of panel 25 is in aligned but opposed relation with respect to the apex of panel 32. When the blank 21 is set up for loading, as seen in FIG. 4, end panels 25, 32 assume a spaced substantially parallel upright relation. The lower edge portion of end panel 32 is connected to an end edge of base panel 22 by a conventional manufacturer's glue flap 33 which may be foldably connected to either the base panel 22, as seen in FIG. 1, or to the lower edge of end panel 32. A pair of tuck flaps 28, 30 are also foldably connected to the side edges of end panel 32.

The hand-gripping unit 31, as seen in FIG. 1, includes a pair of elongated panel sections 34, 35 of like configuration which are connected to one another by an elongated foldline 36. Foldline 36 interconnects the aligned apexes of the upper portions 25*a*, 32*a* of the end panels 25, 32. When the blank 21 is set up, the panel sections 34, 35 assume a face-to-face relation and form a substantially vertical plane which intersects the horizontal base panel 22 and the upright end panels 25, 32.

Extending outwardly from each panel section 34, 35 are connected thereto by a foldline 37, is an article-retaining flap 38, 40. Foldlines 36, 37 are in spaced parallel relation and are substantially coextensive with one another. Each flap 38, 40 is of like configuration and includes a plurality of longitudinally-spaced openings 38*a, b, c*, and 40*a, b, c*. The number of openings in each flap corresponds to the number of articles comprising the adjacent row of articles I, II. Each opening is shaped so as to permit the neck portion of an accommodated article A to readily extend therethrough when the flap 28, 40 is moved from an upright inoperative position X, see FIG. 4, to an outward operative position Y, see FIG. 5.

The outer, distal elongated edge portion 38*d*, 40*d* of each flap is defined by a foldline 41 thereby enabling each edge portion 38*d*, 40*d* to be folded downwardly and be adhesively attached to the upper edge portion 23*a*, 24*a* of the corresponding side panel 23, 24, see FIG. 5 subsequent to the articles having been accommodated within the carrier.

The ends of the panel sections 34, 35 are connected to the adjacent end panel 25, 32 by a pair of connector members 42, 43, respectively. Each member is disposed between and connected to the end of a panel section 34, 35 and one of the convergent foldlines 26 defining the upper tapered portion 25*a*, 32*a* of the end panel.

As noted in FIG. 7, the foldline connection 36 between the panel sections 34, 35 is disposed substantially within a plane formed by the tops of the accommodated articles. Thus, the hand-gripping unit 31 does not interfere with the stacking of a plurality of loaded carriers. To facilitate carrying the loaded carrier 20, the hand-gripping unit panel sections 34, 35 are provided with aligned finger holes H.

The spacing between adjacent openings 38*a–c*, 40*a–c* in each retaining flap 38, 40 is such that, when the necks of the adjacent articles in a row are fully extended through the corresponding opening, as seen in FIG. 5, the upper exterior portions of adjacent articles will be snugly held in proper spaced relation. Thus, each flap prevents contact between the article exterior upper portions, when the loaded carrier is subjected to normal handling. Maintaining proper spacing between the exterior lower portions of the adjacent articles of a row, as well as corresponding articles of the two rows, is effected by a plurality of conventional pushup tabs T formed in the base panel 22. The height and shape of the tabs T will depend in part upon the configuration of the article lower portions, see FIG. 7.

When carrier 20 is to be loaded with articles, the end panels 25, 32 assume upright parallel relation; the panel sections 34, 35 are folded downwardly about foldline 36 into face-to-face relation; and simultaneously therewith the article-retaining flaps 38, 40 are folded to upright positions X, as seen in FIG. 4. While the end panels 25, 32; panel sections 34, 35; and the flaps 38, 40 are disposed in such relative positions, the side panels 23, 24 and the tuck flaps 28, 30 remain unfolded, thereby enabling the rows of articles to be automatically moved simultaneously in lateral directions towards one another through the open sides of the carrier in a manner as seen in FIG. 4. When end flap 38, 40 is in the position X, it will not obstruct movement of the articles onto base panel 22. Prior to the rows of articles being moved onto base panel 22, the push-up tabs T are folded to upright positions in a manner well known in the art. A pair of upright tabs T is disposed between and engages substantially tangentially the lower exterior portions of adjacent articles.

Once the rows of articles have been properly spotted on the base panel 22 between the double push-up tabs, the tuck flaps 28, 30 are folded towards one another, whereupon side panels 25, 32 are folded to upright positions and adhesively secured to the respective tuck flaps. Following the securement of the side panels to the tuck flaps, the article-retaining flaps 38, 40 are folded independently outwardly from their upright inoperative positions X, as seen in FIG. 4, to the operative positions Y, as seen in FIGS. 5 and 7. As the flaps 38, 40 are folded outwardly, the neck portions of the spotted articles will extend through the openings 38*a–c* and 49*a–c* aligned therewith and be snugly embraced by the portions of the flaps circumjacent the respective openings. Because of the longitudinal spacing between adjacent openings in each flap 38, 40, the embraced neck portions of the accommodated articles are retained in substantially the same spaced relation as the lower exterior portions of the articles are spaced by the double push-up tabs T.

The flaps 38, 40 are maintained in operative positions Y by having the outer distal edge portions 38*d*, 40*d* of the flaps folded downwardly and adhesively secured to the upper edge portions of the side panels 23, 34, as seen more clearly in FIGS. 5 and 7.

Because the foldlines 37 connecting the flaps 38, 40 to the respective panel sections 34, 35 are spaced a substantial distance below the foldline 36, the finger holes H formed in the panel sections are readily accessible, thereby facilitating manual carrying of the loaded carrier. The folding of the panel sections 34, 35 into face-to-face relation provides a strong, rigid handle, even though the blank is formed of a relatively lightweight, inexpensive fiberboard commonly used for this purpose.

It will be noted in FIGS. 3–5, that, when the panel sections 34, 35 are moved into face-to-face relation, the connector members 42, 43 attached thereto will simultaneously move into overlying relation with portions of the interior surfaces of the end panels to which they are also connected by foldlines 26. As seen in FIG. 5, the overlying connector members provide an aesthetic shadow-box effect—that is to say only the finished surface of the blank is exposed.

Because of the flexible character of the blank material, the end panels 25, 32 may bow outwardly a slight amount when the unit panel sections 34, 35 are folded into face-to-face relation, thereby facilitating such a manipulation without tearing or rupturing the blank.

Figure 8:
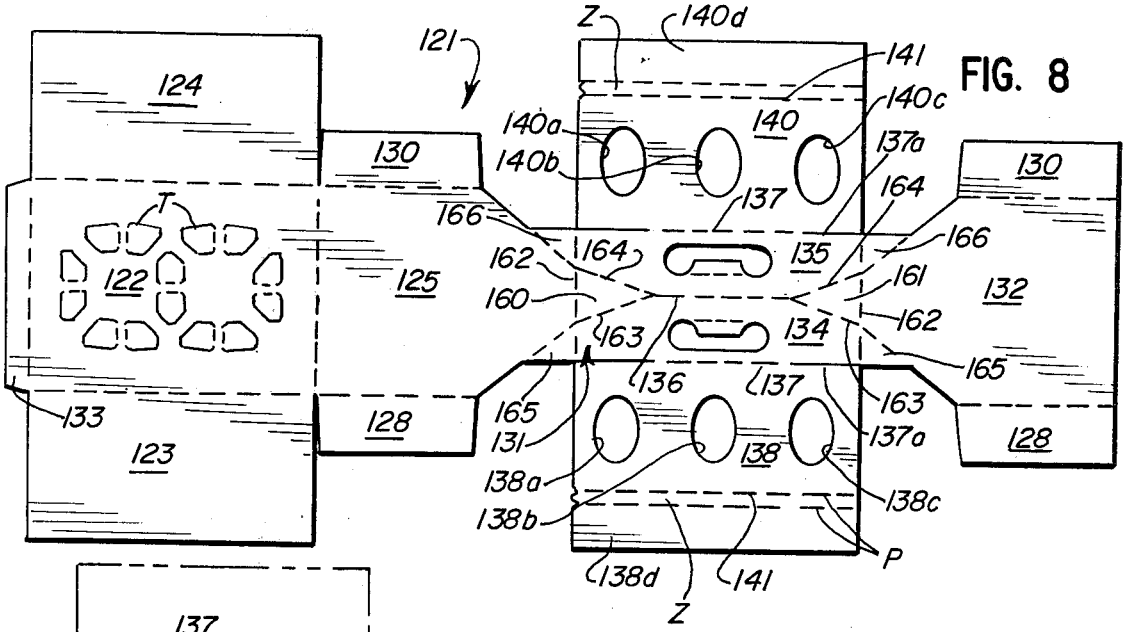
FIG. 8 is similar to FIG. 1, but showing a blank for a second form of improved carrier.

FIG. 8 shows a modified blank 121 for a second form of improved carrier 120. To facilitate understanding of the similarities between blanks 21 and 121, corresponding parts of blank 121 will be identified by the same numbers, but in a 100 series. The principal structural difference between blanks 21 and 121 resides in the hand-gripping unit 131 wherein panel sections 134, 135 are interconnected by a foldline 136 which does not fully span the distance between the end panels 125, 132, but rather the distance between a pair of triangular shaped connector members, sometimes referred to as gusset members 160, 161. One side of each member 160, 161 is connected by a foldline 162 to a top edge portion of the adjacent end panel 125, 132. The side edge portions of each gusset member 160, 161 which converge from opposite ends of foldline 162 are connected by foldlines 163, 164 to the adjacent panel section 134, 135, see FIG. 8.

In addition to the gusset member 160, 161, the opposite end edges of the panel sections 134, 135 may be foldably connected to an adjacent end panel 125, 132 by connecting flaps 165, 166. The latter flaps will partially overlie the interior surfaces of the end panels 125, 132 when the carrier 120 is set up.

Figure 9:
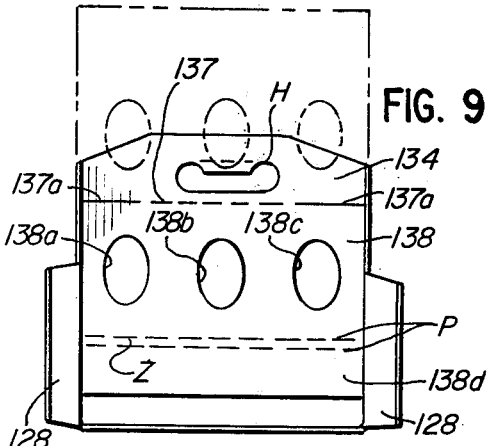
FIG. 9 is a side elevational view of the blank of FIG. 8 in a partially set up condition and with panel sections of the hand-gripping unit folded into face-to-face relation and with the article-retaining flaps, shown in phantom lines, in an article-loading inoperative position.
Figure 11:
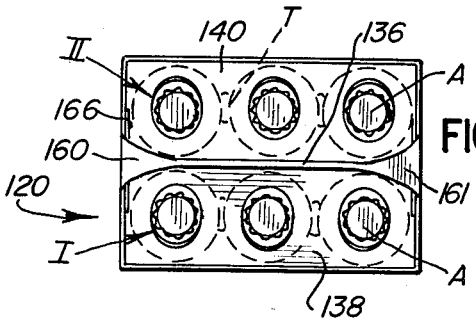
FIG. 11 is a top plan view of the loaded carrier of FIG. 10.
Figure 10:
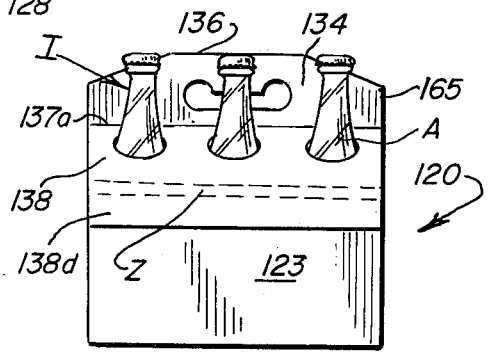
FIG. 10 is a side elevational view of the second form of carrier in a loaded condition.

In order to facilitate folding of the article-retaining flaps 138, 140 between an article-loading (inoperative) position, similar to that shown in FIG. 4 and shown in phantom lines in FIG. 9, to an article-retaining (operative) position, as seen in FIG. 10, slits 137*a* are formed at opposite ends of the foldlines 137 which connect the flaps to the panel sections 134, 135. By reason of the slits 137*a*, the foldlines 136, 137 are substantially coextensive with one another.

Figure 12:
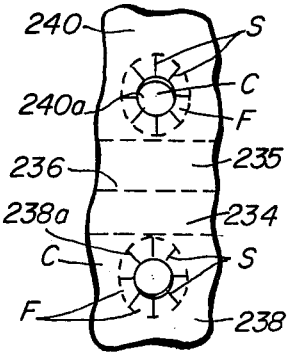
FIG. 12 is an enlarged fragmentary top plan view of a blank for a third form of improved carrier and showing only a portion of the article-retaining flaps thereof.
Figure 13:
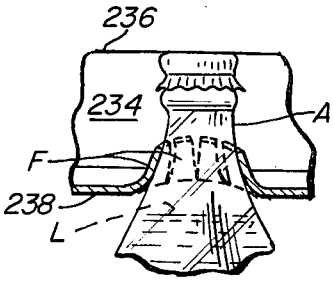
FIG. 13 is an enlarged fragmentary vertical sectional view of one of the flaps of FIG. 12 shown in an operative article-accommodating position.

In both carriers 20, 120, the article-retaining flaps 38, 40 and 138, 140 coact with the end panels 125, 132, and corresponding side panels 123, 124 to provide an effective light shield for the contents of the accommodated articles. However, where greater light shield protection is required, modified openings 238*a–c*, 240*a–c* of a sun-burst design may be formed in the article-retaining flaps 238, 240, see FIG. 12. Each sun-burst opening is provided with a central hole C which has a diameter the same as, or less than the diameter of the top surface of the cap sealing the end of the accommodated article. Extending radially outwardly from the central hole C are a plurality of symmetrically arranged slits S. The slits define a plurality of fingers F which are deflected upwardly when the capped end of the article passes through the aligned opening formed in the flap 238, 240 as the latter is moved to an operative position, see FIG. 13. The deflected fingers F of each aligned opening will snugly embrace the upper neck portion of the article, which is disposed above the level L of the contents of the article A, see FIG. 13.

The configuration of the openings 38*a–c*, 40*a–c*, 138*a–c*, 140*a–c*, 238*a–c*, and 240*a–c*, may vary from that shown and will depend upon the configuration of the neck portion of the article. In any case, however, the openings must be of such a configuration that will enable the article-retaining flap to be readily moved from an inoperative position X to an operative position Y without causing tearing or rupturing of the carrier.

To facilitate removal of the articles from a loaded carrier 20, 120, 220, a conventional tear strip Z may be provided in the distal portion of each article-retaining flap, see for example FIG. 8. In the alternative, the tear strip may be formed on the upper edge portions of the side panels and would remain with the flaps when the carrier is in the second mode. The tear strip of each flap is formed by a pair of parallel perforated scores P. One of the perforated scores may be coincident with the foldline 141. Thus, when the tear strip Z is removed, the unattached portion of the flap which is provided with the openings may be readily moved to the inoperative position X whereupon a selected one or all of the articles of a row can be removed from the carrier.

When the carrier is being reused to accommodate empty articles, the portion of the flap with the openings formed therein can be moved to a vertical, inoperative position, as shown in phantom lines in FIG. 3, whereupon the empty articles can be inserted into the open top compartments disposed on opposite sides of the handgripping unit 31, 131.

Thus, an improved carrier has been provided which readily accommodates a plurality of filled articles and can be reused to accommodate the articles when empty. In addition to complying with governmental regulations and rules regarding packaging of breakable articles, the improved carrier provides an effective light shield for the contents of the articles. The improved carriers are capable of being readily set up and loaded by high-speed automatic equipment, the operation of which is well known in the packaging field.

I claim:

1. A carrier formed from a blank of foldable sheet material for manually carrying a plurality of necked articles arranged in a pair of substantially parallel coextensive rows, said carrier comprising a base panel for subtending and supporting the rows of articles, said base panel having opposed first peripheral segments and opposed second peripheral segments; a pair of opposed end panels foldably connected to and extending upwardly from said base panel first peripheral segments, each end panel being positionable adjacent corresponding end articles of the rows of articles subtended and supported by said base panel; an elongated handgripping unit spanning the distance between upper portions of said upright end panels and being provided with elongated panel sections disposed in substantially face-to-face relation and substantially spanning the distance between said end panels, said panel sections defining a plane substantially perpendicular to said base panel and extending between the rows of articles, corresponding elongated upper portions of said panel sections being foldably interconnected and corresponding lower portions of said panel sections extending into the carrier interior and being spaced from said base panel; first means foldably interconnecting corresponding end portions of said panel sections to separate upper peripheral portions of an adjacent end panel; a pair of opposed side panels foldably connected to and extending upwardly from said base panel second peripheral segments; second means foldably interconnecting adjacent portions of said side and end panels and retaining same in upright angular relation, said unit panel sections, and said side, end and base panels coacting to form substantially contiguous open top compartments separated by the plane defined by said substantially face-to-face panel sections, each compartment being adapted to accommodate at least one row of articles; and article-retaining flaps substantially spanning the distance between said end panels, each flap having an inner edge portion foldably connected to the lower portion of a unit panel section, said flaps being initially movable independently of each other and said panel sections to inoperative substantially upright article-loading positions and subsequently movable to operative outwardly extending article-restraining positions wherein said flaps substantially overlie and close respective open top compartments, and an outer-edge portion of each flap being secured to an upper edge portion of a corresponding upright side panel, each flap being provided with relatively spaced third means for supportingly accommodating and retaining in predetermined spaced relation the neck portions of the articles of a row disposed in an adjacent compartment when the flap is in said operative position.

2. The carrier of claim 1 wherein the third means of each article-retaining flap includes a row of apertures arranged in spaced side-by-side relation, each aperture being sized for receiving therethrough and encompassing the neck portion of a corresponding article when said flap is folded relative to the adjacent panel section from the inoperative position to the operative position.

3. The carrier of claim 1 wherein each unit panel section is provided with at least one finger hole, the holes of said face-to-face panel sections being in substantially registered relation.

4. The carrier of claim 1 wherein the hand-gripping unit panel sections are of substantially like configuration and having corresponding upper edge portions interconnected by a foldline extending substantially normal to said end panels.

5. The carrier of claim 1 wherein each article-retaining flap includes an elongated tear means substantially spanning the distance between said end panels.

6. A blank of foldable sheet material for forming a carrier to accommodate a plurality of necked articles arranged in substantially parallel rows; said blank comprising a base panel for subtending and supportingly engaging the rows of articles; a first end panel foldably connected to a first peripheral segment of said base panel and positionable adjacent one corresponding end of the rows of articles; side panels foldably connected to opposed second peripheral segments of said base panel, each side panel being adapted to be positioned adjacent the articles forming a row; said end panel having opposed first peripheral sections angularly disposed relative to the first peripheral segment of said base panel; first connecting members having first peripheral portions foldably connected to second peripheral sections of said end panel, said second peripheral sections being spaced from said base panel and extending convergently from said first peripheral sections; a pair of elongated panel sections extending endwise from said end panel and disposed opposite from said base panel, the ends of said panel sections adjacent said end panel being foldably connected to second peripheral portions of said connecting members, said panel sections being substantially coextensive and having corresponding first elongated edge portions interconnected by an elongated foldline angularly disposed relative to the folding connection between said connecting members and said panel section ends; a pair of article-retaining flaps disposed on opposite sides of the foldably connected panel sections, each flap being foldably connected to a second elongated edge portion of a panel section and being provided with a plurality of relatively spaced means for accommodating the neck portions of a row of articles; a second end panel disposed endwise of said panel sections and opposite said first end panel; the ends of said panel sections and adjacent peripheral segments of said second end panel being foldably interconnected by second connecting members in a manner similar to the connection between said first end panel and said panel sections by said first connecting members.

7. The blank of claim 6 wherein substantially triangular gusset sections are interposed the opposite ends of the elongated foldline connecting the first elongated edge portions of the panel sections and the adjacent end panels.

8. The carrier of claim 1 wherein the first means includes connector members, each having a first peripheral portion foldably connected to one of the upper portions of an adjacent end panel and a second peripheral portion foldably connected to an adjacent end edge of a unit panel section whereby each connector member assumes a substantially face-to-face relation with the interior surface of the end panel to which it is foldably connected.

* * * * *